US008777822B2

(12) United States Patent
Agostini

(10) Patent No.: US 8,777,822 B2
(45) Date of Patent: Jul. 15, 2014

(54) EXERCISE DEVICE FOR USE IN A DOORWAY INCLUDING RESISTANCE BANDS EXTENDING FROM SLIDABLE CARRIAGES

(76) Inventor: Scott C. Agostini, San Juan Capistrano, CA (US)

( * ) Notice: Subject to any disclaimer, the term of this patent is extended or adjusted under 35 U.S.C. 154(b) by 239 days.

(21) Appl. No.: 13/556,801

(22) Filed: Jul. 24, 2012

(65) Prior Publication Data

US 2014/0031181 A1 Jan. 30, 2014

(51) Int. Cl.
*A63B 21/02* (2006.01)
*A63B 21/04* (2006.01)

(52) U.S. Cl.
USPC ..... 482/129; 482/40; 482/95; 482/96; 482/121; 482/122; 482/124; 482/126; 482/130; 482/904

(58) Field of Classification Search
CPC ..... A63B 21/1663; A63B 21/1645; A63B 21/1627; A63B 21/1654; A63B 21/1636
USPC ..... 482/40, 91–103, 121–126, 129–130, 482/133–139, 904
See application file for complete search history.

(56) References Cited

U.S. PATENT DOCUMENTS

| | | | | | |
|---|---|---|---|---|---|
| 679,784 | A | | 8/1901 | Ryan | |
| 3,218,068 | A | * | 11/1965 | Warman | 482/40 |
| 3,614,097 | A | * | 10/1971 | Blickman | 482/72 |
| 3,707,285 | A | * | 12/1972 | Martin | 482/38 |
| 3,840,227 | A | * | 10/1974 | Chesemore | 482/102 |
| 4,241,914 | A | | 12/1980 | Bushnell | |
| 4,772,011 | A | | 9/1988 | Guridi | |
| 4,861,020 | A | | 8/1989 | Soligny, Sr. | |
| 5,176,602 | A | | 1/1993 | Roberts | |
| 5,186,696 | A | | 2/1993 | Pfefferle et al. | |
| 5,221,240 | A | | 6/1993 | Mann et al. | |
| 5,468,205 | A | * | 11/1995 | McFall et al. | 482/129 |
| 5,577,984 | A | | 11/1996 | Bare, II | |
| 5,593,368 | A | * | 1/1997 | Checketts | 482/27 |
| 5,626,546 | A | | 5/1997 | Little | |
| 6,267,711 | B1 | | 7/2001 | Hinds | |
| 6,514,182 | B1 | * | 2/2003 | Chhloeum | 482/130 |
| 7,819,784 | B1 | | 10/2010 | Caswell et al. | |
| 7,837,602 | B1 | * | 11/2010 | Drybread | 482/102 |

(Continued)

OTHER PUBLICATIONS

Smartgym, "Smartgym", page on web site, Mar. 12, 2012, 1 page, Creative Products Network Inc.

(Continued)

*Primary Examiner* — Loan H Thanh
*Assistant Examiner* — Joshua Lee
(74) *Attorney, Agent, or Firm* — Stetina Brunda Garred & Brucker

(57) ABSTRACT

An exercise device for use in a doorway including resistance bands extending from slidable carriages is provided. The exercise device includes a pair of vertical rail members attachable to sides of a doorway. The vertical rail members are engageable with carriages such that the carriages are capable of being slid longitudinally along the vertical rail members. Resistance bands extend along the vertical rail members and extend out from the carriages. The tension in the resistance bands may be altered by manipulating the distance between the carriages. The resistance bands extending from the carriages are attachable at each end to an athletic accessory such as a hand grip, belt, or crossbar. A pull-up bar may also be attached to the exercise device, the pull-up bar capable of vibration for enhanced performance.

20 Claims, 3 Drawing Sheets

(56) References Cited

U.S. PATENT DOCUMENTS

| | | | | |
|---|---|---|---|---|
| 7,896,786 | B1 | 3/2011 | Osbourne | |
| 8,485,950 | B2 * | 7/2013 | Adams | 482/129 |
| 2008/0139370 | A1 | 6/2008 | Charnitski | |
| 2010/0130338 | A1 * | 5/2010 | Wehrell | 482/124 |
| 2010/0292057 | A1 * | 11/2010 | Dunn | 482/130 |

OTHER PUBLICATIONS

Asseenontvguys.com, "Everlast Door Gym", page on web site, Mar. 12, 2012, 3 pages, As Seen on TV Guys, Inc.

Jake Steinfeld, "Tower 200", page on web site, Mar. 12, 2012, 6 pages, Body by Jake.

* cited by examiner

EXERCISE DEVICE FOR USE IN A DOORWAY INCLUDING RESISTANCE BANDS EXTENDING FROM SLIDABLE CARRIAGES

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention relates generally to an exercise device. More particularly, the present invention relates to an exercise device for use in a doorway, having resistance bands extending from slidable carriages.

2. Related Art

Exercise devices and more particularly home gym devices are well known in the art. Home gym devices for use in a doorway are also known in the field. Often, home gym devices use the structure of a doorway or a wall as an anchor or support for the home gym device. Such a configuration is embodied in various designs generally categorized as home gym devices or home exercise devices.

The most common type of home gym device has a structure that is anchored to a wall or doorway. The structure often has a connecting mechanism for connecting exercise components. Furthermore the structure often allows for multiple configurations. The home gym device is utilized by the user by applying a force to the structure, and the structure anchored or supported by a wall or door frame, resisting the user's force. The force may be applied directly on the structure, or may be applied to an exercise component that is attached to the structure. A common exercise component used for applying force to the structure is an elastic or resistance band. The elastic band can be used for numerous exercises and the elasticity property offers the user varying degrees of resistance.

Ideally, home gym devices allow for several different configurations and provide the user with different exercise options within the comfort of their home. It is desirable that the home gym device substitutes for a complete gym made up of several different exercise devices. However, to substitute for a complete gym, the home gym device must be configurable to accommodate different exercises. Often the more variation provided in the configuration of the home gym device, the larger the device is. While it is desirable to have a wide range of exercises, the home gym device is restricted by space limitations of the user's home.

A number of solutions have been proposed for achieving optimal exercise variety within the space restrictions of a home. For example, a home gym device may include a vertical member structure, a horizontal member for support, a mechanism for anchoring or supporting the structure on a wall, a method of configuring the structure to provide for a variety of exercises, and exercise components such as elastic bands for applying a force to the structure. An example is disclosed in U.S. Pat. No. 7,896,786 to Osbourne. The Osbourne device contemplates a structure that rests against the wall for support. The structure is configurable to accommodate a variety of exercises allowing a user to apply a force to the structure in several different ways. More specifically, the user may use an elastic band to apply a force on the structure, the elastic band being attached to the structure with a pin device or wedged between a crevice within the structure. However, configured this way, the attachment of the elastic band limits the variation of exercises possible. Additionally, the device lacks stability as it is not anchored to the wall or any other rigid structure.

Similar to the Osbourne device is the device disclosed in U.S. Pat. No. 5,626,546 to Little. To provide support for the structure, the Little device is anchored to the wall. Additionally, Little discloses a slidable elastic band attachment to increase the ease of altering the configuration. While the Little device is more stable and easier to configure than the Osbourne device, the device protrudes substantially from the wall. To better conform to the limited space of the users home, home gym devices have been contemplated that are attached to a door or doorway. An example of which is U.S. Pat. No. 6,267,711 to Hinds. The Hinds device attaches to the face of the door and discloses a vertical rail structure with an attaching mechanism movable to fixed locations along the vertical rail structure. The attaching mechanism supports horizontal bars from which a pulley system is mounted. An elastic band attaches to the pulley system, from which a user may apply a force to the structure. While the Hinds device better conforms to the space restrictions of the user's home than the Osbourne and Little devices, the device allows only for limited configuration variation as the only variation results from the change of height of the horizontal bars. Furthermore, the Hinds device is not easily configured considering the elastic band for applying a force to the structure must first be attached to the pulley system and the pulley system must be attached to the horizontal bars.

Alternatively, a number of home gym devices have been contemplated to be attached to a doorway of a user's home. As an example, U.S. Pat. No. 4,772,011 to Guridi discloses vertical supports attached to vertical sides of a doorway with at least one horizontal bar spanning the distance between the vertical supports. While the device conforms to the space restrictions of the user's home, the device obstructs the doorway when installed. Furthermore, the Guridi device is not easily configured to attach an elastic band for applying a force to the structure, nor does it offer a wide variety of exercises.

Accordingly, there is a need in the art for an improved exercise device for use in a doorway.

BRIEF SUMMARY

There is provided an exercise device for use in a doorway including resistance bands extending from carriages. According to one aspect of the present invention, the exercise device for use in a doorway includes a first vertical rail member attachable to a first side of the doorway. A second vertical rail member is similarly attachable to a second side of the doorway. A first carriage is slidably engaged with the first vertical rail member and is sized and configured to move longitudinally along the first vertical rail member. A second carriage is slidably engaged with the first vertical rail member and is sized and configured to move longitudinally along the first vertical rail member. A third carriage is slidably engaged with the second vertical rail member and is sized and configured to move longitudinally along the second vertical rail member. A fourth carriage is slidably engaged with the second vertical rail member and is sized and configured to move longitudinally along the second vertical rail member. A first resistance band with a primary end and an opposing secondary end extends within and along the first vertical rail member and between the first and second carriages. The primary end of the first resistance band extends from the first carriage and the secondary end extends from the second carriage. A second resistance band with a primary end and an opposing secondary end extends within and along the second vertical rail member and between the third and fourth carriages. The primary end of the second resistance band extends from the third carriage and the secondary end extends from the fourth carriage.

In one embodiment of the invention the first, the second, the third and the fourth carriages each further include a locking mechanism sized and configured to respectively engage with the first and second vertical rail members. The locking mechanism is operable for locking the first, the second, the third and the fourth carriages into place at a desired location along the first and the second vertical rail members. It is contemplated that each locking mechanism may be a hand wheel clamp with an engagement member.

In accordance to one aspect of the invention it is contemplated that the first and the second resistance bands have a constant diameter. It is further contemplated that the first, the second, the third, and the fourth carriages each have a resistance band channel. The resistance band channels of the first and the second carriages are capable of allowing passage of the first resistance band and the resistance band channels of the third and the fourth carriages are capable of allowing passage of the second resistance band. The resistance band channels being sized and configured to have a diameter larger than the diameter of the first and the second resistance bands.

In one embodiment of the invention the primary and secondary ends of the first and second resistance bands are attached to catch members for preventing the first and the second resistance bands from becoming disengaged with the first, the second, the third and the fourth carriages. In accordance with another aspect of the invention, the first and second resistance bands may also have attached at their primary end and secondary end an athletic accessory. The athletic accessory may be hand grip, a belt, or a crossbar. In one embodiment of the invention the primary and secondary ends of the first and second resistance bands may each be attached to a catch member and the catch members may each be attached to an athletic accessory.

The exercise device for use in a doorway may further include a vibrating pull-up bar lockably attached to the first and second vertical rail members. It is contemplated that the vibrating pull-up bar extend between the first and second vertical rail members in a perpendicular relationship to the first and second vertical rail members.

A method of configuring the exercise device in a doorway is contemplated such that the first vertical rail member may be fixed to the first side of the doorway. The second vertical rail member may be fixed to the second side of the doorway. The first carriage may be fixed at any point along the first vertical rail member. The first carriage may be slid longitudinally along the first vertical rail member and may be locked into place at a desired location by a locking mechanism. The second carriage may be fixed at any point along the first vertical rail member. The second carriage may be slid longitudinally along the first vertical rail member and may be locked into place at a desired location by a locking mechanism. The third carriage may be fixed at any point along the second vertical rail member. The third carriage may be slid longitudinally along the second vertical rail member and may be locked into place at a desired location by a locking mechanism. The fourth carriage may be fixed at any point along the second vertical rail member. The fourth carriage may be slid longitudinally along the second vertical rail member and may be locked into place at a desired location by a locking mechanism. It is also contemplated that the first resistance band may be engaged with the first vertical rail member and the first and second carriages. The first resistance band may extend along the first vertical rail member and be orientated such that the primary end extends from the first carriage and the secondary end extends from the second carriage. Similarly it is contemplated that the second resistance band may be engaged with the second vertical rail member and the third and fourth carriages. The second resistance band may extend along the second vertical rail member and be orientated such that the primary end extends from the third carriage and secondary end extends from the fourth carriage.

It is contemplated that the tension in the first resistance band may be manipulated by adjusting the distance between the first and second carriage along the first vertical rail member. It is further contemplated that the tension in the second resistance band may be manipulated by adjusting the distance between the third and fourth carriage along the second vertical rail member. Adjusting the distance between the carriages may result in an elongation of the resistance bands creating tension in the resistance bands. Furthermore, manipulating the exercise device in this manner may permit new exercises at each location the carriages are fixed. The exercise device configured in this way offers a wide variety of exercises with minimum effort.

A method of using the exercise device in a doorway in accordance with the described method of configuration is contemplated such that an axial force may be applied on a primary end of at least one of the first or second resistance bands. The applied force may be released and reapplied in a repetitious fashion. It is contemplated that the primary end of the at least one of the first or second resistance bands may be attached to a hand grip. The hand grip employed for applying the axial force on the primary end of the at least one of the first or second resistance bands. It is alternatively contemplated that the primary end of the at least one of the first or second resistance bands may be attached to a belt. The belt employed for applying the axial force on the primary end of the at least one of the first or second resistance bands. Furthermore it is contemplated that the primary end of the at least one of the first or second resistance bands may be attached to a crossbar. The crossbar employed for applying the axial force on the primary end of the at least one of the first or second resistance bands.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment.

It is to be understood, however, that the same or equivalent functions and sequences may be accomplished by different embodiments that are also intended to be encompassed within the spirit and scope of the invention. It is further understood that the use of relational terms such as first and second, top and bottom, and the like are used solely to distinguish one entity from another entity without necessarily requiring or implying any actual such relationship or order between such entities.

Figure 1:
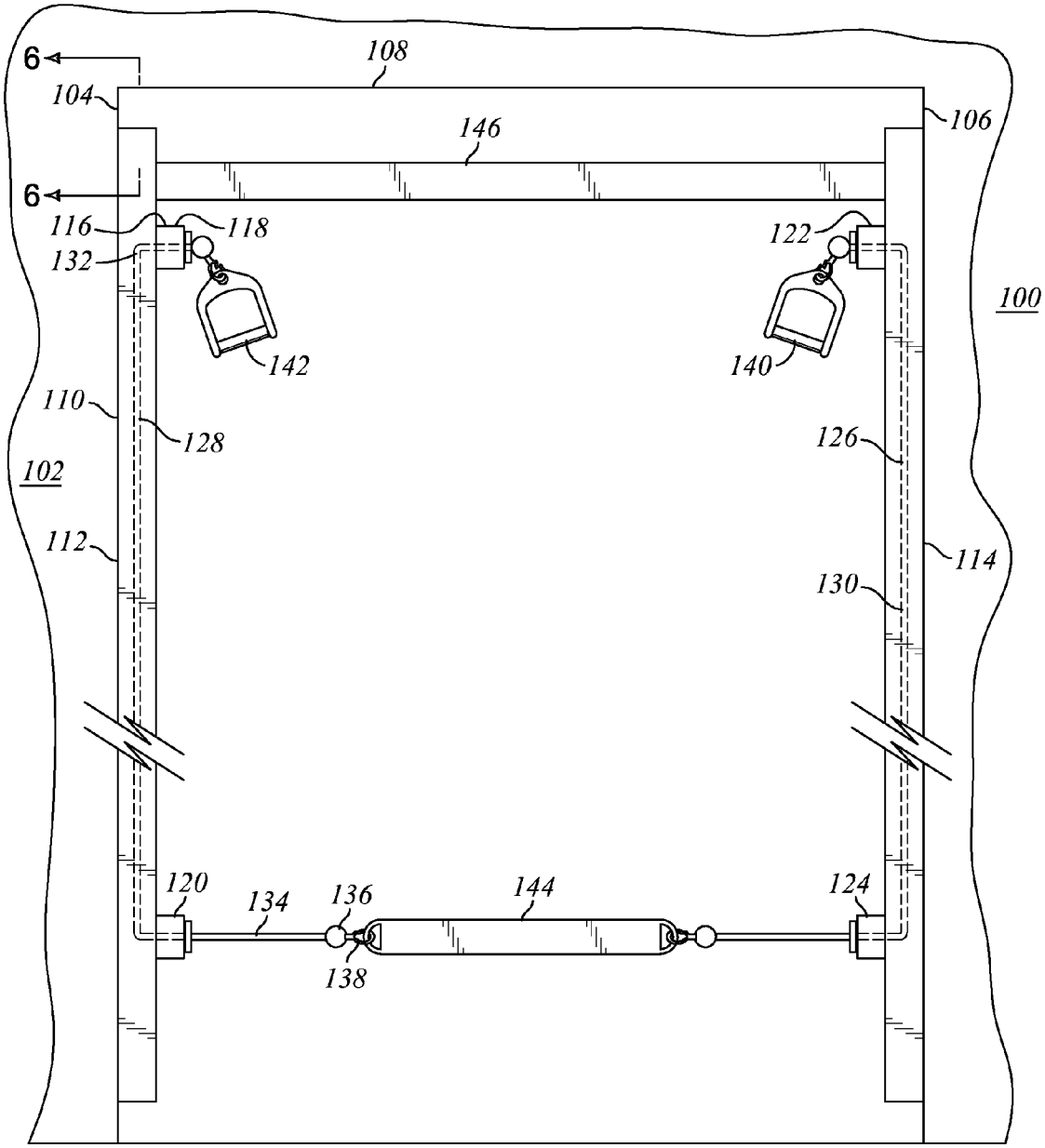
FIG. 1 is a perspective view of an exercise device for use in a doorway having vertical rail members, carriages, resistance bands, athletic accessories and a pull-up bar.

With reference to the perspective view of FIG. 1, a preferred embodiment of an exercise device 100 for use in a doorway 102 in accordance with an aspect of the present invention is illustrated. It is understood that a doorway 102 is generally defined by a door frame and has a first side 104, a second side 106 and a header 108. The first side 104 is generally parallel to the second side 106 and both sides are generally perpendicular the header 108.

The exercise device 100 for use in a doorway 102 is generally comprised of a first vertical rail member 112 attached or fixed to the first side 104 of the doorway 102 and a second vertical rail member 114 attached or fixed to the second side 106 of the doorway 102. The first vertical rail member 112 and second vertical rail member 114 are in a parallel relationship with the first side 104 of the doorway 102 and the second side 106 of the doorway 102. While the embodiment in FIG. 1 displays the first vertical rail member 112 and second vertical rail member 114 attached to a doorway 102, the members may also be attached to opposing walls or any other rigid structure. The embodiment described has a first vertical rail member 112 and second vertical rail member 114, however one of ordinary skill in the art will recognize that an exercise structure employing a single vertical rail member 110 or horizontal rail members or some combination thereof may be used in a similar way. It is contemplated that the first vertical rail member 112 and second vertical rail member 114 may span a substantial portion of the vertical side of the doorway 102. It is to be understood that substantial means greater than fifty percent of the length of the vertical side of the doorway 102.

It is contemplated that the first vertical rail member 112 is slidably engaged with a first carriage 118 such that the first carriage 118 may slide longitudinally along the first vertical rail member 112 but is fixed in every other direction as the first carriage 118 has only one degree of freedom, longitudinal. It is understood that in other embodiments the first carriage 118 may have several degrees of freedom. Additionally, a second carriage 120 may be slidably engaged with the first vertical rail member 112 in the same manner as the first carriage 118. Similarly, a third carriage 122 and a fourth carriage 124 may be slidably engaged with the second vertical rail member 114 in the same manner that the first carriage 118 is slidably engaged with the first vertical rail member 112. While the present embodiment displays a total of four carriages, it is understood that in another embodiment any number of carriages may be slidably engaged with either the first vertical rail member 112 or the second vertical rail member 114.

It is contemplated that the exercise device further includes a first resistance band 128 and a second resistance band 130. Each resistance band 126 has a primary end 132 and a secondary end 134. In the preferred embodiment, the first resistance band 128 extends within and along the first vertical rail member 112. It is contemplated that the primary end 132 of the first resistance band 128 extends through and from the first carriage 118. Similarly it is contemplated that the secondary end 134 of the first resistance band 128 extends through and from the second carriage 120. In a similar manner it is also contemplated that the second resistance band extends within and along the second vertical rail member 114 such that the primary end 132 extends through and from the third carriage 122 and the secondary end 134 extends through and from the fourth carriage 124. In another embodiment, the resistance bands may extend along the vertical rail members 110 without being within and may extend from the carriages 116 without extending through. In another embodiment, multiple resistance bands 126 may extend within and along each vertical rail member 110 and through and from each carriage 116 to increase the amount of tension provided.

In an alternative embodiment, the resistance band 126 may be fixed at the primary end to the vertical rail member 110 and extend within and along the vertical rail member 110, the secondary end ultimately exiting through and from a carriage 116 engaged with the vertical rail member 110. In the preferred embodiment, the resistance band 126 is made of a rubberized silicon material but it is understood that the resistance band 126 may also be made of any material that displays the property of elasticity, such as a spring, for example. In another embodiment, resistance bands 126 of different lengths, cross-sections, and material may be used. It contemplated that non-elastic bands may be used as well.

The primary end 132 and secondary end 134 of each resistance band 126 may be attachable to an athletic accessory 140. The athletic accessory 140 may be used by a user to apply a force on the exercise device 100 via the athletic accessory 140. In FIG. 1, the primary end 132 of the first resistance band 128 and the primary end 132 of the second resistance band 130 are each attached to a hand grip 142. Additionally, the secondary end 134 of the first resistance band 128 and the secondary end 134 of the second resistance band 130 are attached to a crossbar 144. It is understood that in other embodiments, the primary end 132 and secondary end 134 of the resistance band 126 may be attached to other athletic accessories 140 such as a belt 178. It is further understood that the resistance band 126 may be attached to athletic accessories not enumerated herein but known by one of ordinary skill in the art. It is alternatively contemplated that a user may use the exercise device by applying a force directly on the primary end 132 or secondary end 134 of the resistance band 126.

In a preferred embodiment the athletic accessory may be attached to the resistance band 126 with a catch member 136 capable of receiving the resistance band 126 at one end and a spring loaded clip 138 at another end. The spring loaded clip 138 is contemplated to provide a means for attaching and removing the athletic accessory 140 with ease. It is further contemplated that the catch member 136 be a in the shape of the sphere being sized and configured to prevent the resistance band 126 from disengaging with the carriages 116. It is to be understood that the resistance band 126 may alternatively be attached to the athletic accessory 140 by any other means in which the athletic accessory 140 may be attached and removed from the resistance band 126 with minimum effort.

The exercise device 100 may be used by attaching a first vertical rail member 112 and a second vertical rail member 114 to a doorway 102. A first carriage 118 and second carriage 120 may be engaged with the first vertical rail member 112. Additionally a third carriage 122 and fourth carriage 124 may be engaged with the second vertical rail member 114. The user may slide the carriages 116 to a desired location along the vertical rail members 110 and lock the carriages 116 into place via a locking mechanism, such as a hand wheel clamp 164. The user may then extend a first resistance band 126 along and within the first vertical rail member 112 such that the primary end 132 extends through and from the first carriage 118 and the secondary end 134 extends through and from the second carriage 120. Similarly a second resistance band 130 may be extended within and along the second vertical rail member 114 such that the primary end 132 extends through and from the third carriage 122 and the secondary end 134 extends through and from the fourth carriage 124. A catch member 136 may be attached to the primary end 132 and secondary end 134 of the first resistance band 128 and second resistance band 130 such that the resistance bands 126 do not become disengaged with the carriages 116. Configured in this manner, a user may then manipulate the tension in the resistance bands 126 by adjusting the distance between the first carriage 118 and second carriage 120, and the third carriage 122 and fourth carriage 124. It is contemplated that as the distance between the carriages 116 is increased, the resistance bands 126 may become elongated, increasing the tension within the resistance bands 126. Locking the carriages 116 into place while the resistance bands 126 are in tension provides a means for pretensioning the exercise device 100, allowing the user to manipulate the resistance provided by the exercise device 100 with minimum effort.

The user may attach athletic accessories 140 such as a hand grip 142, a belt 178, or a cross-bar 144 to the resistance bands 126 via a spring loaded clip 138 attached to the catch member 136. It is also understood that an athletic accessory 140 may be attached by other means such as a carabiner clip, or any other means in which the athletic accessory 140 can be connected and disconnected from the resistance band 126 with minimum effort. By applying an axial tensile force upon the resistance band 126, either by pulling directly on the resistance band 126 or by employing an athletic accessory 140, the resistance band 126 will be elongated from its original position, creating a resistant force in the opposite direction of the users force, consistent with the theory of elasticity. The user may exercise by releasing and reapplying the tensile force in a repetitious fashion.

It is contemplated that the exercise device 100 used and configured in the described manner may allow for unobstructed passage through the doorway 102 dependent only upon the configuration of the athletic accessories 140 attached. In one embodiment it is contemplated that the exercise device 100 be configured such that one athletic accessory 140 is attached to one end of one resistance band 126. It is also understood however that in another embodiment, one athletic accessory 140 may be attached to both the primary end 132 and secondary end 134 of one resistance band 126. Furthermore, it is understood that one athletic accessory 140 may be attached to one end of the first resistance band 128 and additionally attached to one end of the second resistance band 130. In a similar manner, it is also contemplated that the primary ends 132 and secondary ends 134 of the first resistance band 128 and the second resistance band 130 may all be attached to the same athletic accessory 140, joining all four ends of the two resistance bands 126 together.

Figure 2:
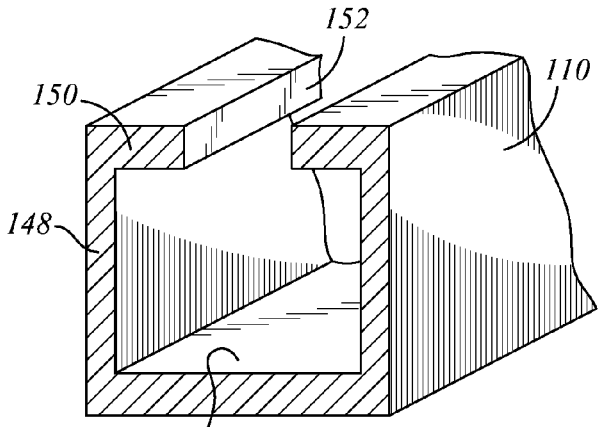
FIG. 2 is a cross-sectional view showing a vertical rail member with a U-shaped cross-section.

FIG. 2 is a cross-sectional view of the vertical rails 110 of FIG. 1, and further details relating to one embodiment of the present invention will be discussed with additional reference thereto. According to one aspect of the present invention, the vertical rail member 110 may have a U-shaped cross-section 148. Consistent with the U-shaped cross-section 148, the vertical rail members 110 may have a protrusion 150 and a gap 152 that spans the length of the vertical rail member 110. In another embodiment, the vertical rail member 110 may have an I-shaped cross-section or any other shaped cross-section that is engageable with a carriage 116.

Figure 3:
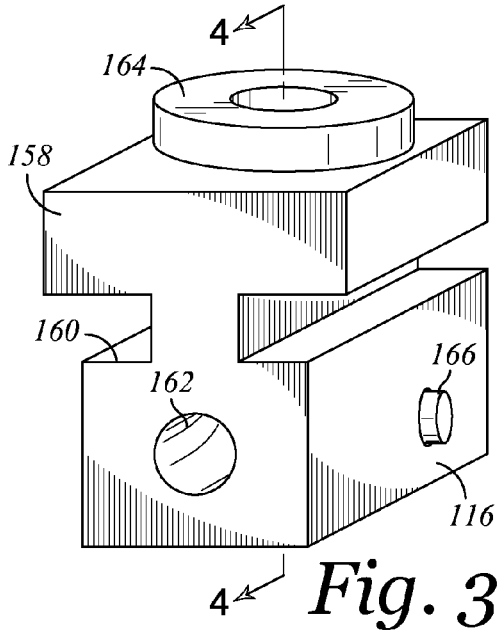
FIG. 3 is a perspective view showing a carriage having an I-shaped cross-section.
Figure 5:
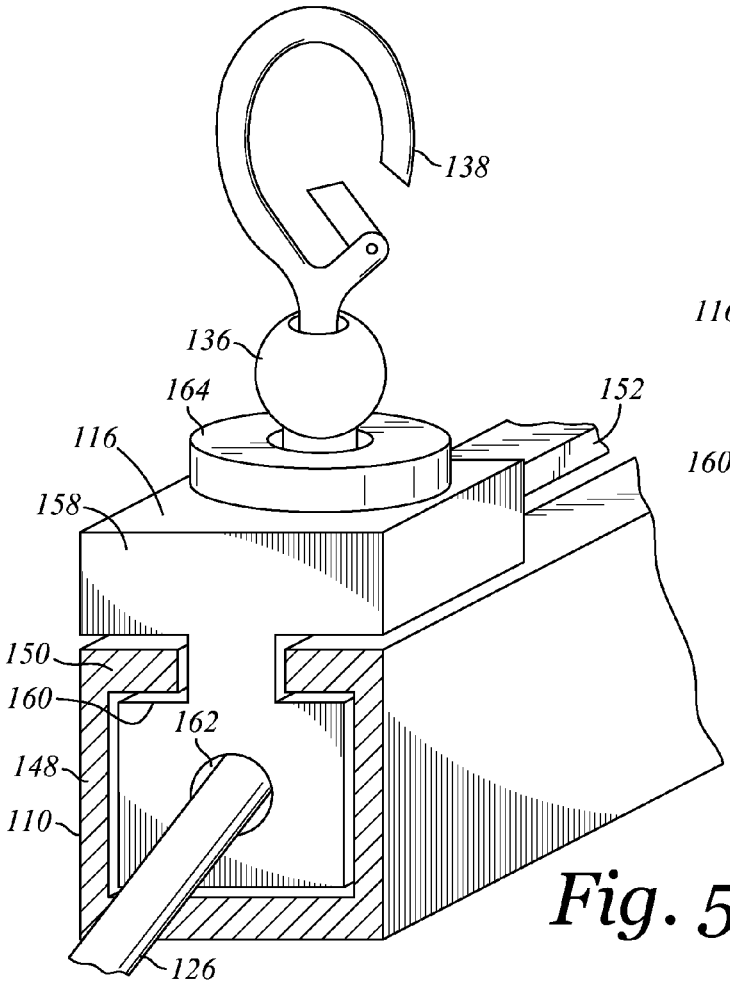
FIG. 5 is a perspective view showing a vertical rail member having a U-shaped cross-section engaged with a carriage having an I-shaped cross-section.

FIG. 3 is a cross-sectional view of the carriage 116 of FIG. 1, and further details relating to one embodiment of the present invention will be discussed with additional reference thereto. According to one aspect of the present invention, the carriage 116 may have an I-shaped cross-section 158. It is contemplated that this I-shaped cross-section 158 be engageable with the U-shaped cross-section 148 of the vertical rail members 110. The I-shaped cross-section 158 further includes an engagement area 160 which interacts with the protrusion 150 and gap 152 of the vertical rail member 110. In FIG. 5, a preferred embodiment of the engagement between the U-shaped cross-section 148 of the vertical rail member 110 and the I-shaped cross-section 158 of the carriage 116 is shown. It is contemplated that the engagement area 160 interact with the protrusion 150 and gap 152 of the vertical rail member 110, such that carriage 116 may only have one degree of freedom. It is also contemplated that the a portion of the I-shaped cross-section 158 of the carriage 116 extend beyond the U-shaped cross-section 148 of the vertical rail member 110, as seen in FIG. 5, such that a user may push the carriage 116 along the vertical rail member 110 by making contact with the exposed area of the carriage 116.

In another embodiment, the carriage 116 may have a U-shaped cross-section and the vertical rail member 110 may have an I-shaped cross-section. It is also contemplated that the carriage 116 and the vertical rail member 110 may have any type of cross-section that permits the vertical rail member 110 to be engageable with the carriage 116 such that the carriage is limited to longitudinal movement only. In another embodiment of the invention, the vertical rail member 110 and carriage 116 may interact by employing a wheel system such that the carriage 116 rolls along the vertical rail member 110. It is understood that the engagement between the carriage 116 and the vertical rail member 110 may be any arrangement such that the carriage 116 is slidable and moves with ease, longitudinally along the vertical rail member 110.

Figure 4:
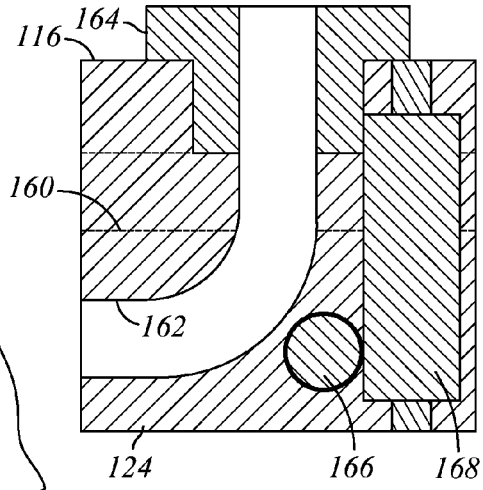
FIG. 4 is a cutaway view showing a carriage having an I-shaped cross-section.

In a preferred embodiment, the carriage 116 may have a locking mechanism in the form of a hand wheel clamp 164 for fixing or locking the carriage 116 at a desired location along the vertical rail members 110, as seen in FIGS. 3, 4 and 5. In one embodiment of the present invention, the hand wheel clamp 164 includes an engagement member 166 that may be extended or retracted by turning the hand wheel clamp 164. It is contemplated that an internal gear 168 exists within the carriage 116 and is engaged with the hand wheel clamp 164 and the engagement member 166 such that when the hand wheel clamp 164 is turned, the internal gear 168 is turned and as a result the internal gear 168 extends or retracts the engagement member 166. It is further contemplated that the engagement member 166 engage with the vertical rail member 110, and as a result, fix or lock the carriage 116 at a desired location along the vertical rail member 110. It is understood that the fixation described may also be achieved by any other locking mechanisms capable of locking, fixing, wedging or pinning the carriage 116 at a desired location along the vertical rail member. It is understood that a locking mechanism such as a hand wheel clamp 164 may permit the user to manipulate the configuration of the exercise device 100 with minimum effort. In this manner, a wide variety of configurations combined with the selection of different athletic accessories 140 offers the user several different types of exercise options. It is contemplated that the exercise device 100, offering a wide variety of exercises, be a substitute for a complete gym having several different exercise devices.

It is further contemplated that the carriages 116 have a resistance band channel 162 for providing a pathway for the resistance band to extend from the interior of the vertical rail member through the carriage 116, and ultimately exit the top of the carriage 116, as seen in FIGS. 3, 4, and 5. In a preferred embodiment, the resistance band channel 162 provides an opening on the side of the carriage 116 allowing for entrance of the resistance band and gradually turns allowing the resistance band to exit the carriage at a degree orientated roughly ninety degrees from the entrance, as seen in FIG. 4. It is understood that the resistance band channel 162 is sized and configured to allow the resistance band 126 to move freely within the resistance band channel 162. In another embodiment, the resistance band channel may take any shape and path that provides a path for the resistance band to travel freely within the carriage 116. It is further contemplated that in another embodiment, the resistance band 126 does not travel through the carriage but instead extends up through the gap 152 of the vertical rail member 110 and is guided by annular elements extending from the carriage 116. It is also contemplated that several resistance bands 126 may extend within one vertical rail member 110 and from one carriage 116 to provide more tension than otherwise may be provided by a single resistance band 126.

Figure 6:
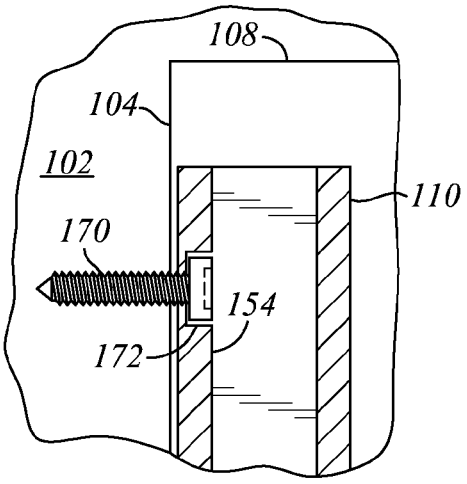
FIG. 6 is cutaway view showing a vertical rail member attached to a doorway with a threaded fastener.

FIG. 6 is a cutaway view of the attachment of the vertical rail member 110 to the first side 104 of the doorway 102. It is contemplated that the vertical rail member 110 may lie against and parallel to the first side 104 of the doorway 102. It is understood that a threaded fastener 170 may have an arrangement of threads for anchoring the vertical rail member 110 to the first side 104 of the doorway 102. Additionally, the threaded fastener 170 may have a pointed tip for penetrating the first side 104 of the doorway 102. In one embodiment of the present invention, a recess 172 may exist within the vertical rail member 110 such that a threaded fastener 170 may fit within, the threaded fastener being substantially flush with the inner wall 154 of the vertical rail member 110 allowing for clearance of the carriage 116. It is also understood that the second vertical rail member 114 may be attached to the second side 106 of the doorway 102 by similar means.

In a preferred embodiment of the present invention, two threaded fasteners 170 are used to anchor the first vertical rail member 112 to the first side 104 of the doorway 102 and two threaded fasteners 170 are used to anchor the second vertical rail member 114 to the second side 106 of the doorway 102. It is contemplated that the threaded fasteners 170 are placed at opposing ends of the vertical rail members 110. It is also understood that any number of threaded fasteners 170 may be used to anchor the vertical rail member 110 to the doorway 102. In another embodiment the vertical rail member 110 may be attached or fixed to a rigid surface such as vertical wall. Additionally, it is also understood that the vertical rail member 110 may be attached or fixed to a doorway 102 or other rigid surface by a means other than a threaded fastener such as a clamp or an adhesive or any other means capable anchoring the vertical rail member 110 to a rigid surface.

Figure 7:
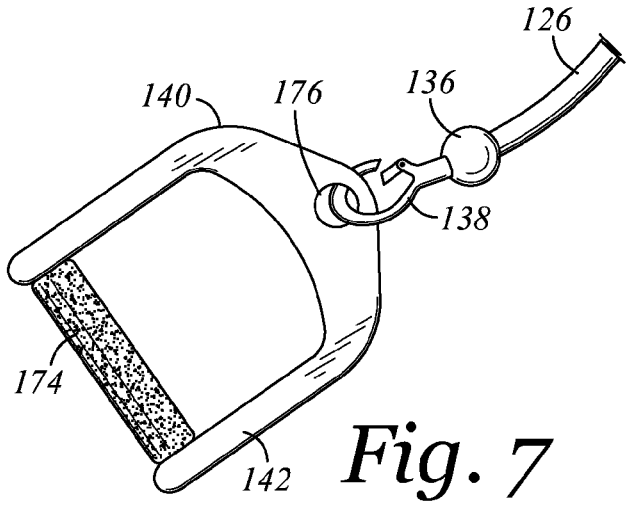
FIG. 7 is perspective view of a hand grip attached to a resistance band.
Figure 8:
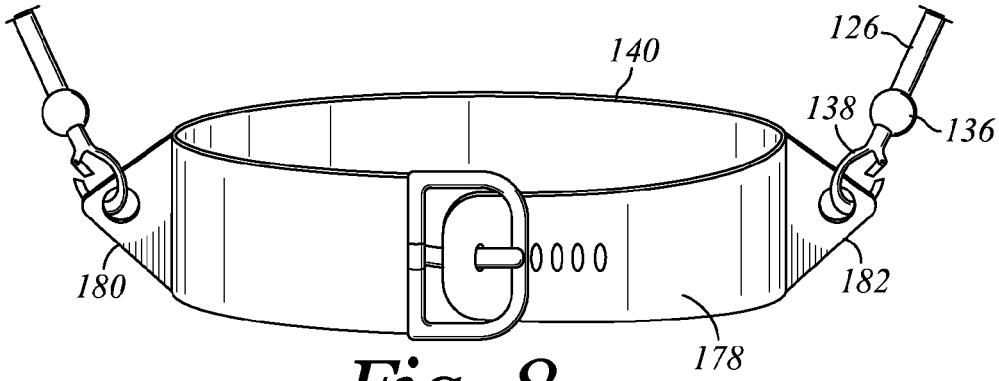
FIG. 8 is a perspective view of a belt attached to resistance bands.
Figure 9:
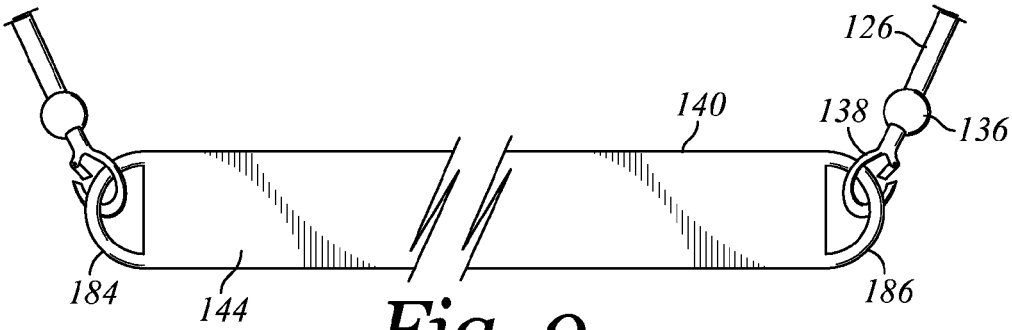
FIG. 9 is a perspective view of a crossbar attached to resistance bands.

With reference to FIGS. 7, 8, and 9, in a preferred embodiment, an athletic accessory 140 may be attached to the resistance band 126 by a spring loaded clip 138 engaged with a catch member 136 as described above. In another embodiment, it is contemplated that the resistance band be attached to the athletic accessory 140 by a carabiner clip or a clamp. It is also contemplated that the resistance band 126 may be attachable to the athletic accessory 140 by any other means in which the resistance band 126 may be connected and disconnected from the athletic accessory 140 with minimum effort.

More specifically, in one embodiment of the invention, the athletic accessory 140 attached to the resistance band 126 may be a hand grip 142, as seen in FIG. 7. It is contemplated that the hand grip 142 may have an attachment area 176 capable of receiving the spring loaded clip 138 attached to the resistance band 126. The hand grip 142 may also have a gripping area 174 used for gripping and pulling on the hand grip 142 to apply an axial force on the resistance band 126. It is understood that the hand grip 142 may take any shape or form, such as a rope or a rod, capable of being gripped and attached to a resistance band 126. It is further understood that in other embodiments of the present invention, the hand grip 142 may be attached to the resistance band 126 by other means such a carabiner clip, or any other mean in which the hand grip 142 may be connected and disconnected from the resistance band 126 with minimum effort.

In another embodiment, the athletic accessory 140 attached to the resistance band 126 may be a belt 178, as seen in FIG. 8. It is further contemplated that the belt 178 may have a left side 180 and a right side 182, each side capable of receiving a spring loaded clip 138 attached to a resistance band 126. In one embodiment of the invention, the belt 178 may be used to wrap around the waist area of the user. In this manner the user may apply a force on the resistance bands 126 by moving their body relative to the exercise device 100. In a different embodiment, the belt 178 may be wrapped around an appendage such as the leg of a user. It is understood that the belt 178 may be attached to the resistance bands 126 by a carabiner clip or any other means in which the belt 178 can be connected and disconnected from the resistance bands 126 with minimum effort. It is further understood that the belt 178 may be used with attachment to only one resistance band 126. It is contemplated that the fastening mechanism on the belt 178 be a belt buckle but it is understood that the belt 178 may fasten by other means such as Velcro.

In another embodiment, the athletic accessory 140 attached to the resistance band 126 may be a crossbar 144 as seen in FIG. 9. It is contemplated that the crossbar may have a left side 184 and a right side 186. It is further contemplated that the left side 184 and right side 186 be capable of receiving a spring loaded clip 138 attached to a resistance band 126. In this manner, a user may grip the crossbar 144 with both hands, each hand on opposing sides of the crossbar 144. With the crossbar 144 gripped, the user may apply a force such that the attached resistance bands 126 each experience a tensile force. It is understood that the crossbar 144 may be attachable to the resistance bands 126 by other means such as a carabiner clip, or any other means in which the crossbar can be connected and disconnected from the resistance band 126 with minimum effort. It is also contemplated that the crossbar 144 may have a curvature or take any other form capable of being gripped by both hands of the user.

It is to be understood that any combination of athletic accessories 140 may be attached to the exercise device 100. For example, it is contemplated that the first resistance band 128 and the second resistance band 130 may each be attached to a hand grip 142 at their primary ends 132. It is further contemplated that the first resistance band 128 and second resistance band 130 may both be attached to a crossbar 144 and their secondary ends 134. It is also understood that the resistance bands 126 may be attached to athletic accessories not now known or not explicitly enumerated herein.

In one embodiment of the invention, the exercise device 100 further includes a pull-up bar 146 as seen in FIG. 1. It is contemplated that the pull-bar 146 has an internal mechanism for causing vibration. Studies have shown that vibration in exercise equipment is beneficial in that it enhances results. In other embodiments, the pull-up bar 146 may be devoid of a vibrating mechanism. It is contemplated that the pull-up bar 146 extend between the first vertical rail member 112 and the second vertical rail member 114, having a perpendicular relationship with the first vertical rail member 112 and the second vertical rail member 114 and a parallel relationship with the header 108 of the doorway 102.

In one embodiment of the invention, the pull-up bar 146 is capable of becoming fixed to the vertical rail member 110 with a clamp. In another embodiment of the invention, the pull-up bar may become fixed to the vertical rail member 110 by becoming wedged within the gap 152 and protrusion 150 of the vertical rail member 110. It is understood that the pull-up bar may alternatively be attached to the first side 104 of the doorway 102 and the second side 106 of the doorway 102 by means such as, but not limited to, a clamp. It is further understood that the pull-up bar may be placed at any location along the first vertical rail member 114 and second vertical rail member 112, while retaining the parallel relationship to the header 108.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. An exercise device for use in a doorway, the doorway defined by a door frame, the doorway having a first side, a second side parallel to the first side and a header perpendicular to and extending between the first and second sides, the exercise device comprising:

a first vertical rail member attachable to the first side of the doorway;

a second vertical rail member attachable to the second side of the doorway;

a first carriage slidably engaged with the first vertical rail member, the first carriage being sized and configured to move longitudinally along the first vertical rail member;

a second carriage slidably engaged with the first vertical rail member, the second carriage being sized and configured to move longitudinally along the first vertical rail member;

a third carriage slidably engaged with the second vertical rail member, the third carriage being sized and configured to move longitudinally along the second vertical rail member;

a fourth carriage slidably engaged with the second vertical rail member, the fourth carriage being sized and configured to move longitudinally along the second vertical rail member;

a first resistance band with a primary end and an opposing secondary end, the first resistance band extending within and along the first vertical rail member and between the first and second carriages, the primary end extending from the first carriage and the secondary end extending from the second carriage; and a second resistance band with a primary end and an opposing secondary end, the second resistance band extending within and along the second vertical rail member and between the third and fourth carriages, the primary end extending from the third carriage and the secondary end extending from the fourth carriage.

2. The exercise device of claim 1, wherein the first and second vertical rail members are sized longitudinally to span a substantial portion of the first and the second sides of the doorway.

3. The exercise device of claim 1, wherein the first, the second, the third and the fourth carriages each further include a locking mechanism sized and configured to respectively engage with the first and second vertical rail members, locking the first, the second, the third and the fourth carriages into place at a desired location along the first and the second vertical rail members.

4. The exercise device of claim 3, wherein each locking mechanism is a hand wheel clamp with an engagement member sized and configured to respectively engage the first and second vertical rail members, locking the first, the second, the third and the fourth carriages into place at a desired location along the first and the second vertical rail members.

5. The exercise device of claim 1, wherein the first and second resistance bands have a constant diameter and the first, the second, the third, and the fourth carriages each have a resistance band channel capable of allowing passage of the first and second resistance bands through the first, the second, the third, and the fourth carriages.

6. The exercise device of claim 1, further including catch members attached to the primary and secondary ends of the first and second resistance bands for preventing the first and the second resistance bands from becoming disengaged with the first, the second, the third and the fourth carriages.

7. The exercise device of claim 1, wherein the first resistance band is attached to a hand grip.

8. The exercise device of claim 1, wherein the first and the second resistance bands are attached to a belt.

9. The exercise device of claim 1, wherein the first and the second resistance bands are attached to a crossbar.

10. The exercise device of claim 1, further including a vibrating pull-up bar that is lockably attached to the first and second vertical rail members, the vibrating pull-up bar extending between the first and second vertical rail members and in a parallel relationship with the header of the doorway.

11. The exercise device of claim 1, wherein the first and second vertical rail members are attachable to the doorway with threaded fasteners.

12. A method of configuring an exercise device in a doorway, the doorway defined by a door frame, the doorway having a first side and a second side parallel to the first side and a header perpendicular to and extending between the first and second sides, the method comprising:

fixing a first vertical rail member to the first side of the doorway;

fixing a second vertical rail member to the second side of the doorway;

fixing a first carriage along the first vertical rail member, the first carriage slid longitudinally along the first vertical rail member and locked into place at a desired location by a locking mechanism;

fixing a second carriage along the first vertical rail member, the second carriage slid longitudinally along the first vertical rail member and locked into place at a desired location by a locking mechanism;

fixing a third carriage along the second vertical rail member, the third carriage slid longitudinally along the second vertical rail member and locked into place at a desired location by a locking mechanism;

fixing a fourth carriage along the second vertical rail member, the fourth carriage slid longitudinally along the second vertical rail member and locked into place at a desired location by a locking mechanism;

engaging a first resistance band, having a primary end and a secondary end, with the first vertical rail member and the first and second carriages such that the first resistance band extends along the first vertical rail member and the primary end and the secondary end respectively extend from the first and second carriages; and engaging a second resistance band, having a primary end and a secondary end, with the second vertical rail member and the third and fourth carriages such that the second resistance band extends along the second vertical rail member and the primary end and the secondary end respectively extend from the third and fourth carriages.

13. A method as recited in claim 12, further comprising:

manipulating the tension in the first resistance band by adjusting the distance between the first and second carriages along the first vertical rail member; and manipulating the tension in the second resistance band by adjusting the distance between the third and fourth carriages along the second vertical rail member.

14. A method as recited in claim 12, further comprising:

attaching a hand grip to the primary end of the first resistance band.

15. A method as recited in claim 12, further comprising:

attaching a belt with a right and left side to the secondary end of the first and second resistance bands; wherein the left side of the belt is attached to the first resistance band and the right side of the belt is attached to the second resistance band.

16. A method as recited in claim 12, further comprising:

attaching a crossbar with a right and left side to the secondary end of the first and second resistance bands; wherein the left side of the crossbar is attached to the first resistance band and the right side of the crossbar is attached to the second resistance band.

17. A method of using an exercise device in a doorway, the doorway defined by a door frame, the doorway having a first side, a second side parallel to the first side and a header perpendicular to and extending between the first and second sides, the method comprising:

fixing a first vertical rail member to the first side of the doorway;

fixing a second vertical rail member to the second side of the doorway;

fixing a first carriage along the first vertical rail member, the first carriage slid longitudinally along the first vertical rail member and locked into place at a desired location by a locking mechanism;

fixing a second carriage along the first vertical rail member, the second carriage slid longitudinally along the first vertical rail member and locked into place at a desired location by a locking mechanism;

fixing a third carriage along the second vertical rail member, the third carriage slid longitudinally along the second vertical rail member and locked into place at a desired location by a locking mechanism;

fixing a fourth carriage along the second vertical rail member, the fourth carriage slid longitudinally along the second vertical rail member and locked into place at a desired location by a locking mechanism;

engaging a first resistance band, having a primary end and a secondary end, with the first vertical rail member and the first and second carriages such that the first resistance band extends along the first vertical rail member and the primary end and the secondary end respectively extend from the first and second carriages;

engaging a second resistance band, having a primary end and a secondary end, with the second vertical rail member and the third and fourth carriages such that the second resistance band extends along the second vertical rail member and the primary end and the secondary end respectively extend from the third and fourth carriages;

applying an axial force on a primary end of at least one of the first or second resistance bands; and releasing and reapplying the axial force in a repetitious fashion.

18. A method as recited in claim 17, further comprising:

attaching a hand grip to the primary end of the at least one of the first or second resistance bands; and employing the hand grip for applying the axial force on the primary end of the at least one of the first or second resistance bands.

19. A method as recited in claim 17, further comprising:

attaching a belt to the primary end of the at least one of the first or second resistance bands; and employing the belt for applying the axial force on the primary end of the at least one of the first or second resistance bands.

20. A method as recited in claim 17, further comprising:

attaching a crossbar to the primary end of at least one of the first or second resistance bands; and employing the crossbar for applying the axial force on the primary end of the at least one of the first or second resistance bands.

* * * * *